US006453696B1

(12) United States Patent
Kawasumi et al.

(10) Patent No.: US 6,453,696 B1
(45) Date of Patent: Sep. 24, 2002

(54) AUTOMATIC ICE MAKER OF THE OPEN-CELL TYPE

(75) Inventors: Masaaki Kawasumi, Shimane-ken; Masahiro Kodani; Shinichi Nagasawa, both of Izumo; Chiyoshi Toya; Shinsaku Hayakawa, both of Nagoya, all of (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 0 days.

(21) Appl. No.: 09/838,568

(22) Filed: Apr. 20, 2001

(30) Foreign Application Priority Data

Apr. 21, 2000 (JP) ..... 2000-121498

(51) Int. Cl.[7] ..... F25C 1/00
(52) U.S. Cl. ..... 62/344; 62/347
(58) Field of Search ..... 62/347, 344, 348, 62/352; 248/229.16, 229.26, 230.7

(56) References Cited

U.S. PATENT DOCUMENTS

| | | | | |
|---|---|---|---|---|
| 2,729,070 A | | 1/1956 | Ames | 62/107 |
| 3,430,452 A | | 3/1969 | Dedricks et al. | 62/138 |
| 4,966,015 A | * | 10/1990 | Wessa | 62/347 |
| 5,329,780 A | * | 7/1994 | Broadbent | 62/347 |
| 5,722,244 A | * | 3/1998 | Shelton | 62/347 |
| 5,941,091 A | * | 8/1999 | Broadbent | 62/347 |
| 6,062,036 A | * | 5/2000 | Hobelsberger | 62/347 |
| 6,148,633 A | | 11/2000 | Yamada et al. | 62/347 |

FOREIGN PATENT DOCUMENTS

| | | |
|---|---|---|
| GB | 2 021 746 | 12/1979 |
| JP | 11-182999 | 6/1999 |

* cited by examiner

*Primary Examiner*—William E. Tapolcal
*Assistant Examiner*—Mohammad M. Ali
(74) *Attorney, Agent, or Firm*—Arent Fox Kintner Plotkin & Kahn

(57) ABSTRACT

An automatic ice maker of the open-cell type including a housing composed of a pair of spaced side wall panels and front and rear wall panels jointed at their opposite ends to the side wall panels, a water storage tank mounted to the bottom of the housing, a sprinkler mounted within the bottom portion of the housing and having a plurality of nozzles for spouting upward ice making water supplied from the water storage tank, a cooling pipe mounted within an ice making chamber formed in an upper portion of the housing, a plurality of ice making cell casings horizontally mounted in the ice making chamber and located above the nozzles of the sprinkler to be supplied with the ice making chamber spouted therefrom and to be cooled by refrigerant supplied into the cooling pipe, and an ice chute in the form of a lattice placed in a forwardly inclined condition between the sprinkler and the ice making cell casings to permit the ice making water spouted into the cell casings therethrough from the nozzles of the sprinkler and to receive ice cubes formed in and released from the cell casings, wherein the ice chute is detachably mounted on a forwardly inclined support portion provided on the side wall panels in the interior of the housing and retained in place by resilient engagement with the support portion, wherein the water storage tank is supported at its opposite sides on a pair of spaced support portions integrally formed with the lower ends of the side wall panels when inserted into a bottom space of the housing from its front and is retained in place by engagement with the support portions of the side wall panels, and wherein the sprinkler is supported and retained in place on a pair of spaced support portions integrally formed with the lower ends of the side walls and located above the water storage tank.

9 Claims, 7 Drawing Sheets

AUTOMATIC ICE MAKER OF THE OPEN-CELL TYPE

BACKGROUND OF THE INVENTION

1. Field of the Invention

The present invention relates to an automatic ice maker of the open-cell type.

2. Discussion of the Prior Art

Illustrated in FIGS. 11 and 12 is a conventional automatic ice maker of the open-cell type which includes a box-type housing 1 composed of a pair of side walls 1*a* connected with each other by means of front and rear wall panels 1*c* and 1*b*, a water storage tank 2 mounted to the bottom of housing 1, a sprinkler 3 mounted on the bottom plate of housing 1 for spouting ice making water upward from its nozzles 3*a*, and a plurality of ice making cell casings 4*b* mounted in an ice making chamber 4 formed in an upper portion of housing 1. An inclined ice chute 6 is placed in the interior of housing 1, and a shutter 7 is suspended from the front wall panel 1*c* of housing 1 at a lower side of the ice chute 6.

A cooling pipe 5 mounted on an upper plate 4*a* of ice making chamber 4 is connected to a refrigerant conduit 10 to be supplied with refrigerant from a freezing circuit including a compressor 11, a condenser 12 cooled by a cooling fan 13, a dehydrator 14 and an expansion valve 15. In the freezing circuit, a hot-gas valve 16 is provided in parallel with the condenser 12, dehydrator 14 and expansion valve 15. When the freezing circuit is activated in a condition where the hot-gas valve has been closed, the ice making chamber 4 is cooled by the refrigerant supplied into the cooling pipe 5 from the freezing circuit. When the expansion valve 15 is closed while the hot-gas valve 16 is being opened, the evaporated refrigerant is compressed by the compressor and supplied as hot-gas into the cooling pipe 5.

The ice making water W in water storage tank 2 is supplied into the sprinkler 3 by operation of a water pump (not shown), spouted upward from each nozzle 3*a* through openings of ice chute 6 and brought into contact with the internal surface of each ice making cell casing 4*b* cooled by the refrigerant supplied from the freezing circuit. Thus, the ice making water is partly frozen in each cell casing 4*b*, and a remainder of the water is returned into the water storage tank 2. The ice cubes formed in the cell casings 4*b* are enlarged in the course of lapse of a time. When hot-gas is supplied into the cooling pipe 5 in a condition where the cell casings 4*b* have been filled with the ice cubes, the ice making chamber 4 is heated by the hot-gas to release the ice cubes from cell casings 4*b*, and the ice cubes are received by the inclined ice chute 6 and slip downward on the ice chute 6 to open the shutter 7. Thus, the ice cubes are delivered into an ice storage cabinet (not shown) through the shutter 7.

In such a conventional automatic ice maker of the open-cell type described above, the water storage tank 2 is formed at its upper portion with a pair of outward flanges 2*a* which are engaged with a pair of outward flanges 1*d* formed on lower ends of side wall panels 1*a* and fixed in place by means of fastening screws 2*b* as shown in FIG. 12. Similarly, the sprinkler 3 is formed at its opposite sides with a pair of upward flanges 3*b* which are engaged with inner surfaces of the side wall panels 1*a* and fixed in place by means of fastening screws 3*c*. In addition, the ice chute 6 is formed at its opposite sides with a pair of upward flanges 6*a* which are engaged with the inner surfaces of side wall panels 1*a* and fixed in place by means of fastening screws 6*b*.

As the ice cubes produced by the ice maker are used as food, the interior of the ice maker has to be maintained always in a clean condition. In a district where city water containing impurities such as silica, calcium or the like is used in the ice maker, the impurities adhere to the component parts of the ice maker such as the water storage tank 2, sprinkler 3 and ice chute 6 and solidify during lapse of a time. It is, therefore, required to remove the component parts from the housing for cleaning. However, removal of the component parts is troublesome since it is required to remove the fastening screws respectively. If the fastening screws are rusted, removal of the fastening screws will become difficult. In the assembly process of the component parts, it is also required to coincide each of the component parts with the corresponding mounting hole for fastening the screws.

In addition, to manufacture the automatic ice maker in various sizes, it is required to prepare the housing, water storage tank, sprinkler and ice chute in different sizes in accordance with the ice making performance of the ice maker. Particularly, as the housing is composed of molding parts complicated in construction, the preparation of molding dies for each ice maker housing causes an increase of the manufacturing cost.

SUMMARY OF THE INVENTION

It is, therefore, a primary object of the present invention to provide an automatic ice maker of the open-cell type the component parts of which can be disassembled in a simple manner for cleaning and assembled without any trouble.

According to the present invention, the object is accomplished by providing an automatic ice maker of the open-cell type which includes a housing composed of a pair of spaced side wall panels and front and rear wall panels jointed at their opposite ends to the side wall panels, a water storage tank mounted to the bottom of the housing, a sprinkler mounted within the bottom portion of the housing and having a plurality of nozzles for spouting upward ice making water supplied from the water storage tank, a cooling pipe mounted within an ice making chamber formed in an upper portion of the housing, a plurality of ice making cell casings horizontally mounted in the ice making chamber and located above the nozzles of the sprinkler to be supplied with the ice making chamber spouted therefrom and to be cooled by refrigerant supplied into the cooling pipe, and an ice chute in the form of a lattice placed in a forwardly inclined condition between the sprinkler and the ice making cell casings to permit the ice making water spouted into the cell casings therethrough from the nozzles of the sprinkler and to receive ice cubes formed in and released from the cell casings, wherein the ice chute is detachably mounted on a forwardly inclined support portion provided on the side wall panels in the interior of the housing and retained in place by resilient engagement with the support portion.

According to an aspect of the present invention, there is provided an automatic ice maker of the open-cell type which includes a housing composed of a pair of spaced side wall panels and front and rear wall panels jointed at their opposite ends to the side wall panels, a water storage tank mounted to the bottom of the housing, a sprinkler mounted within the bottom portion of the housing and having a plurality of nozzles for spouting upward ice making water supplied from the water storage tank, a cooling pipe mounted within an ice making chamber formed in an upper portion of the housing, a plurality of ice making cell casings horizontally mounted in the ice making chamber and located above the nozzles of the sprinkler to be supplied with the ice making chamber spouted therefrom and to be cooled by refrigerant supplied into the cooling pipe, and an ice chute in the form of a lattice placed in a forwardly inclined condition between the sprinkler and the ice making cell casings to permit the ice making water spouted into the cell casings therethrough from the nozzles of the sprinkler and to receive ice cubes formed in and released from the cell casings, wherein the water storage tank is supported at its opposite sides on a pair of spaced support portions integrally formed on the lower ends of the side wall panels when inserted into a bottom space of the housing from its front and is retained in place by engagement with the support portions of the side wall panels.

According to another aspect of the present invention, there is provided an automatic ice maker of the open-cell type which includes a housing composed of a pair of spaced side wall panels and front and rear wall panels jointed at their opposite ends to the side wall panels, a water storage tank mounted to the bottom of the housing, a sprinkler mounted within the bottom portion of the housing and having a plurality of nozzles for spouting upward ice making water supplied from the water storage tank, a cooling pipe mounted within an ice making chamber formed in an upper portion of the housing, a plurality of ice making cell casings horizontally mounted in the ice making chamber and located above the nozzles of the sprinkler to be supplied with the ice making chamber spouted therefrom and to be cooled by refrigerant supplied into the cooling pipe, and an ice chute in the form of a lattice placed in a forwardly inclined condition between the sprinkler and the ice making cell casings to permit the ice making water spouted into the cell casings therethrough from the nozzles of the sprinkler and to receive ice cubes formed in and released from the cell casings, wherein the sprinkler is supported and retained in place on a pair of spaced support portions integrally formed on the lower ends of the side wall panels and located above the water storage tank when inserted into the interior of the housing from its front.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENTS

Figure 1:
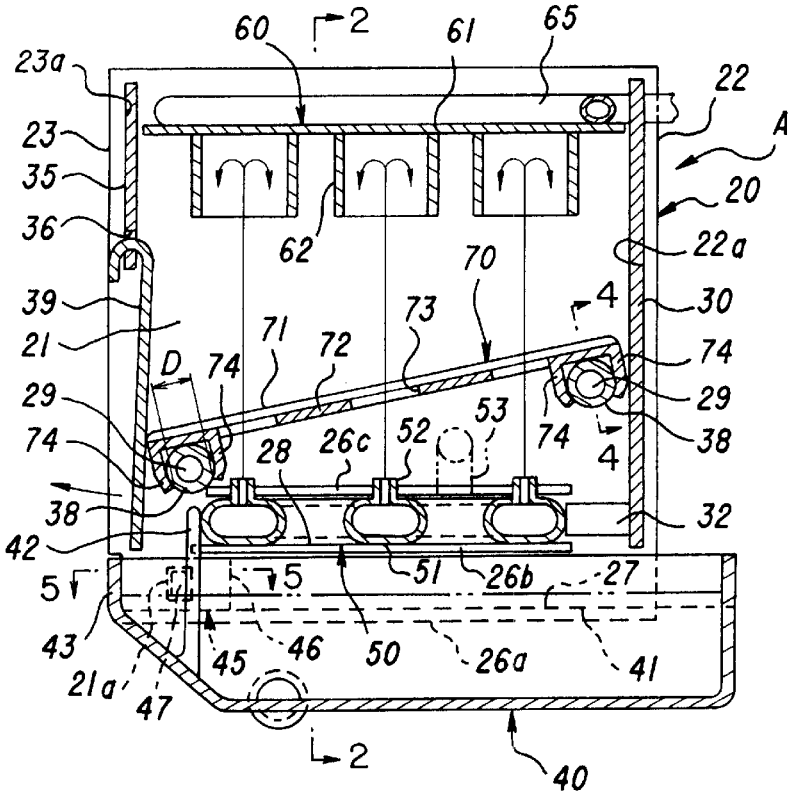
FIG. 1 is a vertical sectional view of an automatic ice maker of the open-cell type in accordance with the present invention.
Figure 2:
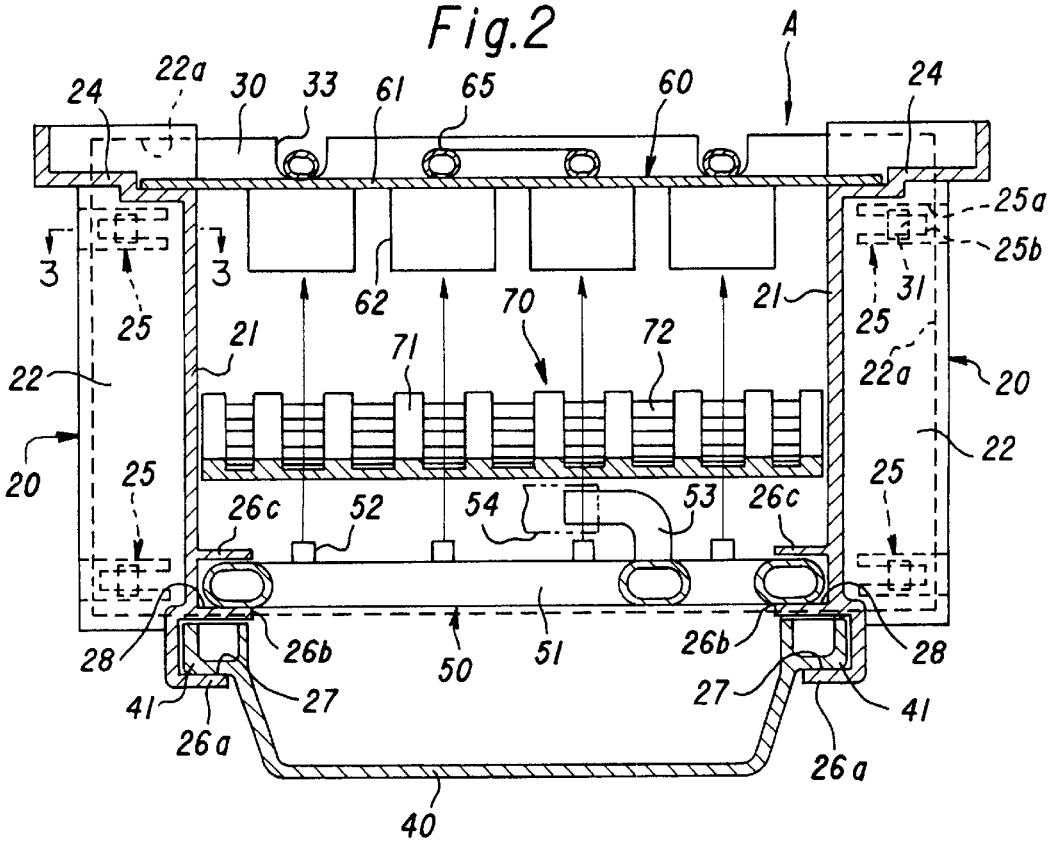
FIG. 2 is a vertical sectional view taken along line 2—2 in FIG. 1.

Illustrated in FIGS. 1 and 2 is an embodiment of an automatic ice maker of the open-cell type in accordance with the present invention, which is composed of a box-type housing A, a water storage tank 40 mounted to the bottom of housing A, a sprinkler 50 mounted within the bottom portion of housing A, an ice making chamber 60 formed in an upper portion of housing A and an ice chute 70 mounted within the interior of housing A under the ice making chamber 60.

Figure 4:
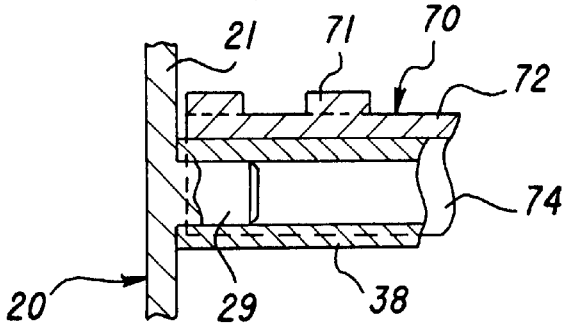
FIG. 4 is a sectional view taken along line 4—4 in FIG. 1.

The box-type housing A is composed of a pair of side wall portions 20 connected to each other by means of front and rear wall panels 35 and 30. The lower half of front wall panel 35 is opened, and a shutter 39 is suspended from the front wall panel 35 to close the lower half opening. As clearly shown in FIGS. 2 and 6, the side wall portions 20 each are in the form of a side wall panel 21 which is integrally formed with a pair of parallel vertical flanges 23 and 22 extended outward from its front and rear ends, an upper lateral flange 24 extended outward from its upper end, a lower lateral flange 26*a* extended inward from its lower end and a pair of parallel lateral ribs 26*b* and 26*c* extended inward from its lower portion. The side wall portions 20 are made of synthetic resin. A support groove 27 for support of the water storage tank 40 is formed between the lower lateral flange 26*a* and lateral ribs 26*b* of side wall panel 21, and a support groove 28 for support of the sprinkler 50 is formed between the parallel lateral ribs 26*b* and 26*c* of side wall panel 21. As shown in FIGS. 1 and 4, the side wall panels 21 each are integrally formed at their internal surfaces with a pair of spaced front columnar projections 29 and a pair of rear columnar projections 29 located above the lateral rib 26*c*. The front columnar projections 29 are located lower than the rear columnar projections 29.

Figure 3:
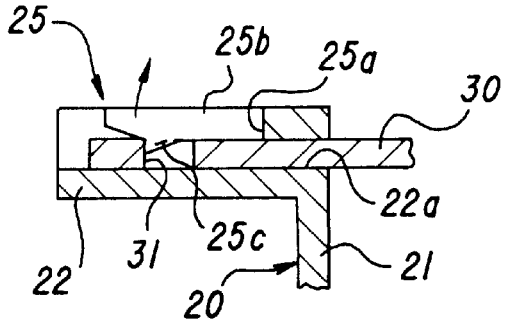
FIG. 3 is a cross-sectional view taken along line 3—3 in FIG. 2.
Figure 6:
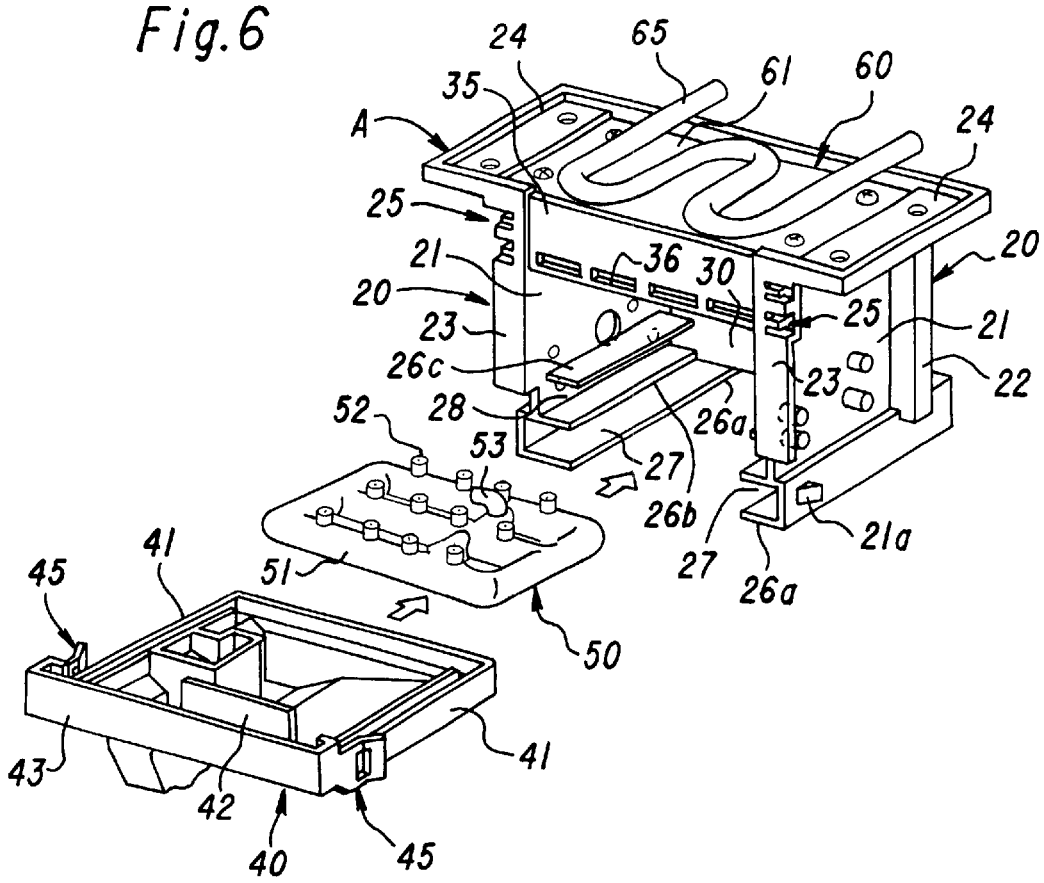
FIG. 6 is a perspective view of the ice maker in a condition where a sprinkler and a water storage tank have been removed out of the ice maker housing.

As shown in FIGS. 2 and 3, the rear lateral vertical flange 22 of side wall panel 21 has a vertical slit 22*a* formed to permit insertion of each side end of rear wall 30 and a latch mechanism 25 provided to retain each side end of rear wall panel 30 by engagement therewith. The latch mechanism 25 is composed a resilient leg 25*b* formed by a U-shaped recess 25*a* in the vertical flange 22 and a pawl 25*c* of triangle shape in section formed on the resilient leg 25*b* to be projected in the vertical slit 22*a*. Similarly, as shown in FIG. 6, the front vertical flange 23 has a vertical slit 23*a* formed to permit insertion of each side end of front wall panel 35 and a latch mechanism (not shown) provided to retain each side end of front wall panel 35 by engagement therewith as in the latch mechanism 25 of rear vertical flange 22.

The rear wall panel 30 is in the form of a rectangular panel of synthetic resin which is formed at its opposite sides with rectangular holes 31 corresponding with the latch portions 25 of rear vertical flanges 22 as shown in FIG. 3. The rear wall panel 30 is inserted into the vertical slits 22*a* of rear vertical flanges 22 at its opposite side ends and retained in place by engagement with the pawls 25*c* of resilient legs 25*b* at its rectangular holes 31. The rear wall panel 30 has a plurality of spaced stoppers 32 formed at its lower portion for engagement with the rear end of sprinkler 50 as shown in FIGS. 1 and 6 and a pair of laterally spaced recesses 33 formed at its upper end for insertion of the cooling pipe 65 as shown in FIG. 2.

The front wall panel 35 is in the form of a rectangular panel of synthetic resin smaller in vertical width than the rear wall panel 30. As in the rear wall panel 30, the front wall panel 35 is inserted into the vertical slits 23*a* of front vertical flanges 23 at its opposite side ends and retained in place by engagement with the pawls of front vertical flanges 23 as shown in FIG. 6. As shown in FIG. 1, the front wall panel 35 has a plurality of spaced slits 36 formed for suspending the shutter 39 therefrom.

Thus, the box-type housing A is formed by assembling the rear and front wall panels 30 and 35 with the rear and front vertical flanges 22 and 23 of side wall panels 21 as described above. The ice chute 70 is supported on a pair of tubular support rods 38 which are spaced in a fore-and-aft direction of housing A and retained in place by engagement with the columnar projections 29 of side wall panels 21 at their opposite ends as shown in FIG. 1.

The water storage tank 40 is made of synthetic resin and opened at its upper portion. As shown in FIGS. 1 and 2, the water storage tank 40 is formed with a pair of outwardly projected portions 41 extending in parallel along its opposite upper ends. The vertical width of projected portions 41 is slightly smaller than that of the support grooves 27 formed on the lower ends of side wall panels 21. The water storage tank 40 is formed at the front portion of its bottom with an upright thrust member 42. The water storage tank 40 is detachably assembled with the bottom of housing A by engagement with the support grooves 27 of side wall panels 21 at its outwardly projected portions 41 to be movable in the fore-and-aft direction of housing A.

Figure 5:
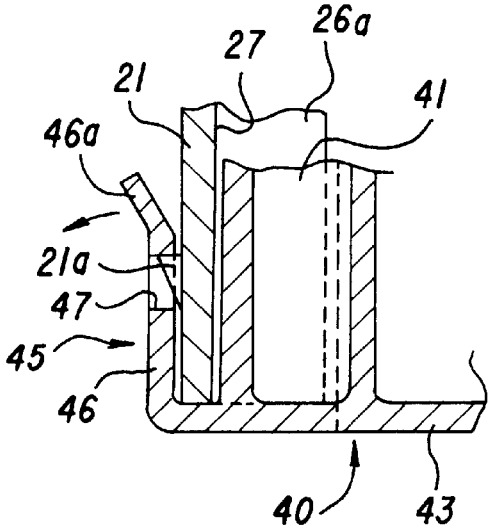
FIG. 5 is a cross-sectional view taken along line 5—5 in FIG. 1.

As shown in FIGS. 1 and 5, the projected portions 41 of water storage tank 40 are provided with latch mechanisms 45 at their front portions. The latch mechanisms 45 are composed of a pair of resilient legs 46 integrally formed with opposite ends of a front plate 43 of tank 40 as shown in FIG. 5 and a pair of pawls 21*a* formed on each lower front end portion of side wall panels 21 to be projected into rectangular holes 47 respectively formed in the resilient legs 46. When the projected portions 41 of water storage tank 40 are inserted into the support grooves 27 of side wall panels 21 from the front of housing A and pushed rearward, the resilient legs 46 of tank 40 are brought into engagement with the pawls 21*a* of side wall panels 21 at their rectangular holes 47 to retain the water storage tank 40 in place at the bottom of housing A. When it is desired to remove the water storage tank 40 out of the housing A, each outward end 46*a* of the resilient legs 46 is moved outward to disengage the resilient legs 46 from the pawls 21*a* of side wall panels 21. With such operation, the water storage tank 40 can be removed from the bottom of housing A.

As shown in FIGS. 1 and 2, the sprinkler 50 is composed of three parallel flattened conduits 51 connected with each other by means of a pair of side conduits, a plurality of nozzles 52 provided on the flattened conduits 51 and a water supply port 53 provided on one of the side conduits as shown in FIG. 6. The component parts of sprinkler 50 are integrally made of synthetic resin in entirety. The vertical width of sprinkler 50 is smaller than that of the support groove 28 formed between the parallel lateral ribs 26*b* and 26*c* of each side wall panel 21. In the assembly process of sprinkler 50, the side conduits of sprinkler 50 are inserted into the support grooves 28 from the front of housing A and positioned in place by abutment against the stoppers 32 formed on the rear wall 30 as shown in FIG. 1. Thus, the sprinkler 50 is retained in place by engagement with the upright thrust members 42 formed on the bottom of water storage tank 40.

Figure 8:
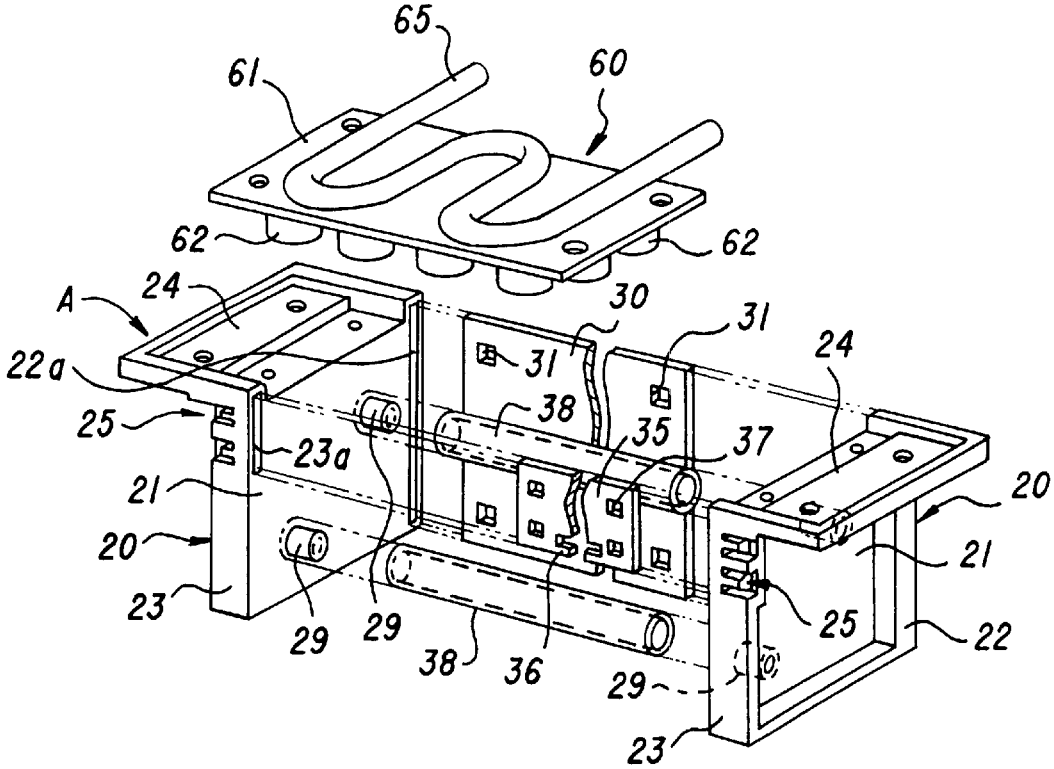
FIG. 8 is a perspective view illustrating a disassembled condition of the ice maker housing.
Figure 9:
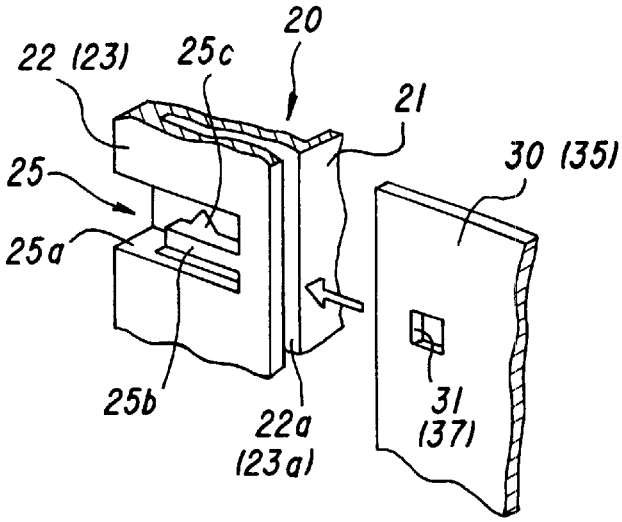
FIG. 9 is a perspective view illustrating a disassembled condition of a joint portion of a rear wall panel and a side wall panel shown in FIG. 8.
Figure 11:
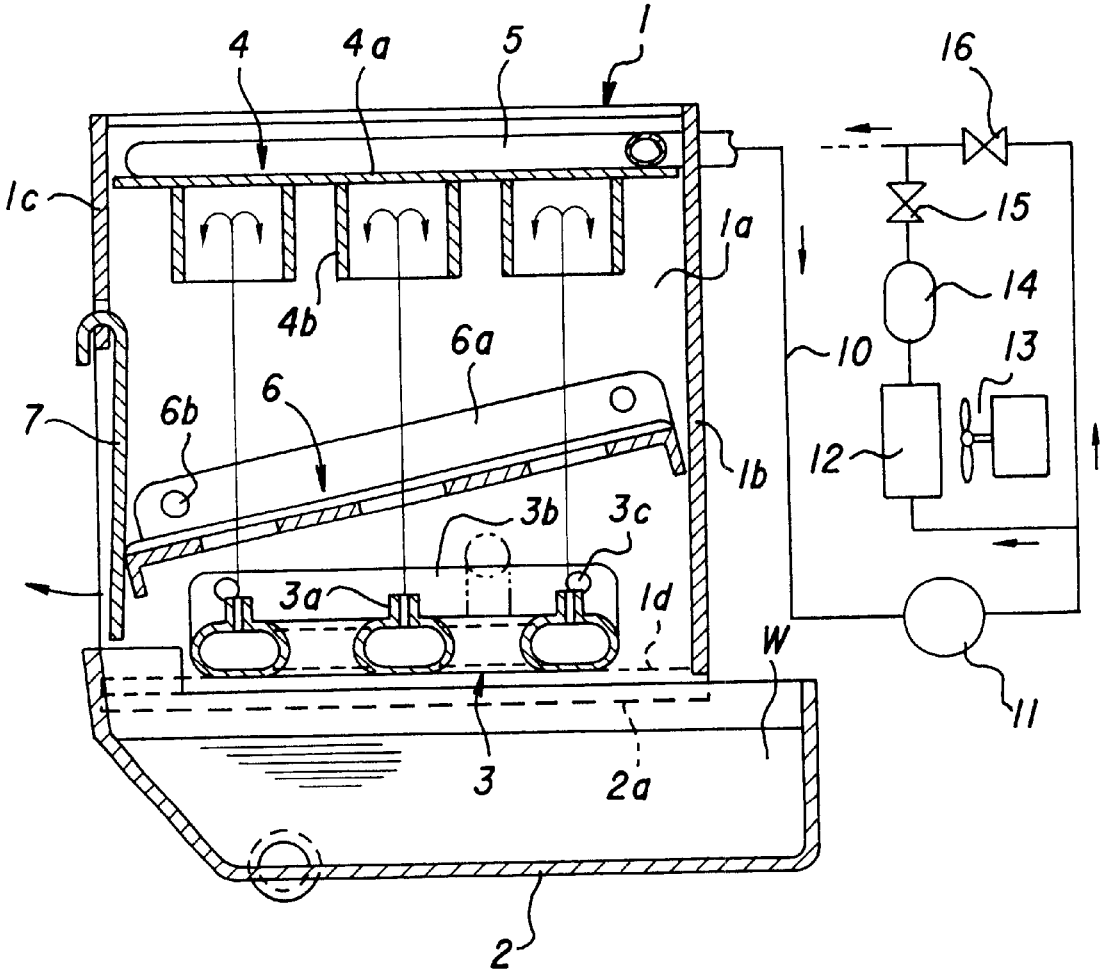
Fig.11 PRIOR ART
FIG. 11 is a vertical sectional view of a conventional ice maker of the open-cell type.
Figure 12:
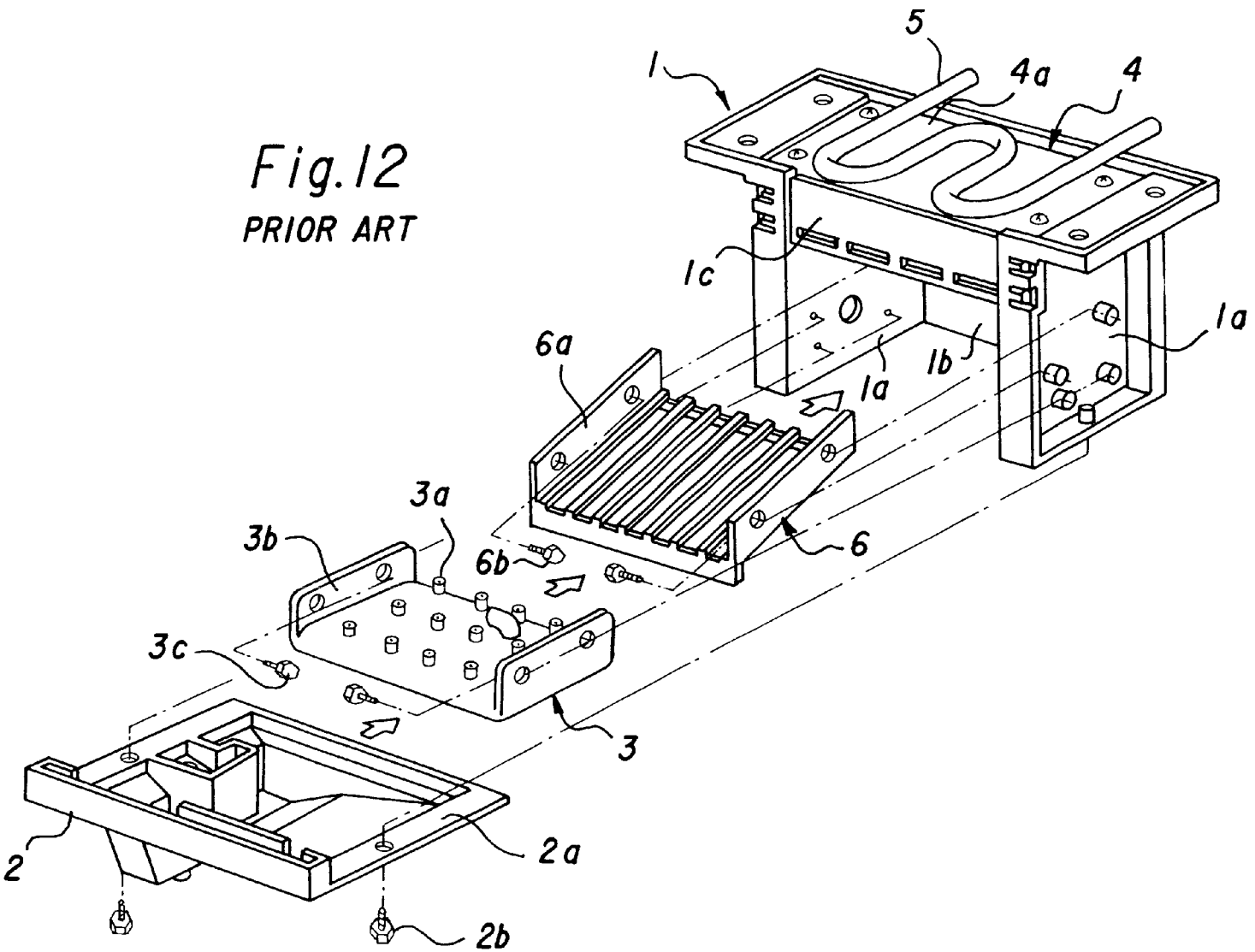
Fig. 12 PRIOR ART
FIG. 12 is a perspective view illustrating a disassembled condition of the conventional ice maker shown in FIG. 11.

As shown in FIGS. 1, 2 and 8, the ice making chamber 60 is formed to contain a plurality of ice making cell casings 62 welded to the bottom surface of a flat base plate 61 and opened downward. The ice making cell casings 62 each are in the form of a piece of cut pipe and located above each nozzle 52 of sprinkler 50. The base plate 61 and cell casings 62 are made of copper or aluminum superior in heat conductivity. A cooling pipe 65 is meanderingly secured on the base plate 61 and located above each center of cell casings 62. The cooling pipe 65 is connected to a refrigerant conduit to be supplied with refrigerant from a freezing circuit as in the conventional ice maker shown in FIGS. 11 and 12. In the ice making chamber 60, as shown in FIGS. 2 and 8, the flat base plate 61 is mounted on a pair of support brackets 24 formed on the upper ends of side wall panels 21 and fixed in place by fastening screws.

Figure 7:
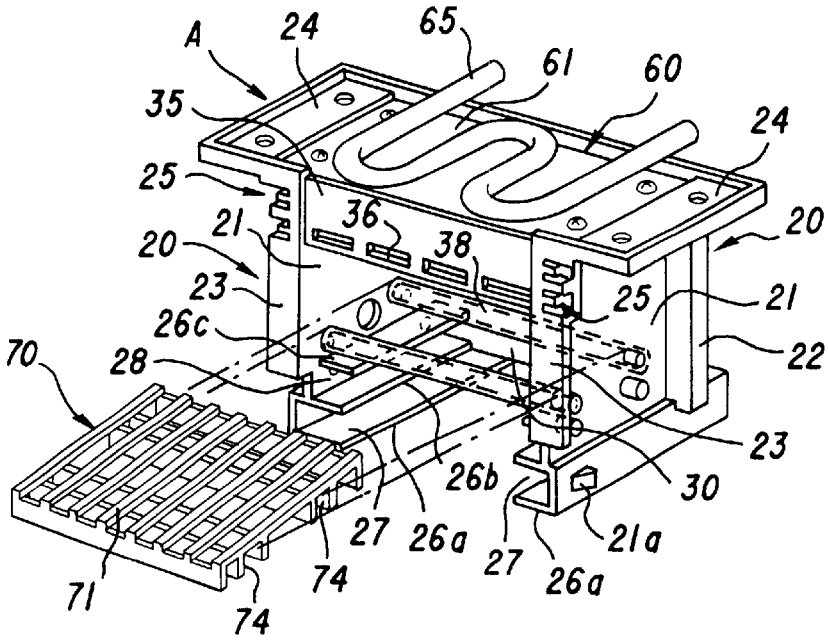
FIG. 7 is a perspective view of the ice maker in a condition where an ice chute has been removed out of the ice maker housing.

As shown in FIGS. 1, 2 and 7, the ice chute 70 is composed of a plurality of spaced slide plates 71 arranged in the fore-and-aft direction of housing A and connected by a plurality of spaced lateral plates 72 in the form of a lattice. The ice chute 70 has a pair of spaced parallel support legs 74 provided at its front and rear portions for engagement with the tubular support rods 38. The support legs 74 of ice chute 70 each are formed with a pair of resilient leg segments spaced in width D slightly smaller than the outer diameter of support rod 38. The component parts of ice chute 70 are integrally made of synthetic resin in entirety. In the assembly process of the ice chute 70, the support legs 74 of ice chute 70 are resiliently engaged with the tubular support rods 38 in such a manner that the ice chute 70 is inclined forward in the housing A.

In operation of the ice maker, the ice making chamber 60 is cooled by refrigerant supplied into the cooling pipe 65 from the freezing circuit, and the ice making water in tank 40 is supplied into the sprinkler 50 by operation of a water pump mounted to the bottom of tank 40 through a hose 54. The ice making water is spouted upward from each nozzle 52 of sprinkler 50 through openings of ice chute 70 and brought into contact with the internal surface of each ice making cell casing 62 cooled by the refrigerant. Thus, the ice making water is partly frozen in each cell casing 62, and a remainder of the water is returned into the water storage tank 40 and supplied again into the sprinkler 50. The ice cubes formed in the cell casings 62 are enlarged in the course of lapse of a time. When hot-gas is supplied into the cooling pipe 65 in a condition where the cell casings 62 have been filled with the ice cubes, the ice making chamber is heated by the hot-gas to release the ice cubes from cell casings 62, and the ice cubes are received by the inclined ice chute 70 and slip downward on the ice chute 70 to open the shutter 39. Thus, the ice cubes are delivered into an ice storage cabinet (not shown) through the shutter 39.

When it is desired to remove the water storage tank 40 for cleaning, the outward ends 46*a* of resilient legs 46 are moved outward to disengage the resilient legs 46 from the pawls 21*a* of side walls 21. With this operation, as shown in FIG. 6, the water storage tank 40 can be pulled out of the support grooves 27 formed in the projected portions 41 of side wall panels 21. When the water storage tank 40 is removed out of the bottom of housing A, the upright thrust member 42 formed on the bottom tank 40 is removed from the sprinkler 50. Thus, the sprinkler 50 can be pulled out of the support grooves 28 of side wall panels 21. When it is desired to assembly the water storage tank 40 and sprinkler 50 with the bottom portion of housing A, the sprinkler 50 is first inserted into the support grooves 28 of side wall panels 21 from the front of housing A. Thereafter, the water storage tank 40 is inserted into the support grooves 27 of side wall panels 21 and retained in place by engagement with the pawls 21*a* of side walls 21 at its resilient legs 46 when it has been inserted into the innermost ends of support grooves 27. In such an instance, the sprinkler 50 is positioned in place by engagement with the upright thrust member 42 formed on the bottom of tank 40. As the water storage tank 40 and sprinkler 50 can be detachably assembled with the side wall panels 21 of housing A in a simple manner, it is able to wash the tank 40 and sprinkler 50 for maintaining them in a clean condition and for preventing clog of the sprinkler 50 at its nozzles 52.

To remove the ice chute 70 out of the interior of housing A, the front support leg 74 of ice chute 70 is disengaged upward from the front support rod 38, and the rear support leg 74 of ice chute 70 is disengaged upward from the rear support rod 38. Thus, as shown in FIG. 7, the ice chute 70 can removed out of the interior of housing A. For mounting the ice chute 70 within the housing A, the front and rear support legs 74 of ice chute 70 are resiliently engaged with the front and rear support rods 38 to retain the ice chute in an inclined position. With such operation, the ice chute 70 can be detachably assembled within the housing A in a simple manner to be maintained in a clean condition.

To manufacture the automatic ice maker of the open-cell type in various sizes, it is required to prepare the housing, water storage tank, sprinkler, ice making chamber and ice chute in different sizes in accordance with the ice making performance of the ice maker. Particularly, as the housing is composed of molding parts complicated in construction, the preparation of molding dies for each ice maker housing causes an increase of the manufacturing cost. To solve such problem, the box-type housing A in the embodiment is composed of the front and rear wall panels 35 and 30 assembled with the pair of side wall panels 21. Accordingly, the side wall panels 21 formed with the vertical flanges 22 and 23 complicated in construction can be used as common parts in the case that the front and rear wall panels 35 and 30 adjusted in size are assembled to provide the box-type housing A in different size for use in an ice maker of different ice making performance. As a result, the ice maker can be manufactured in various sizes at a low cost.

Figure 10:
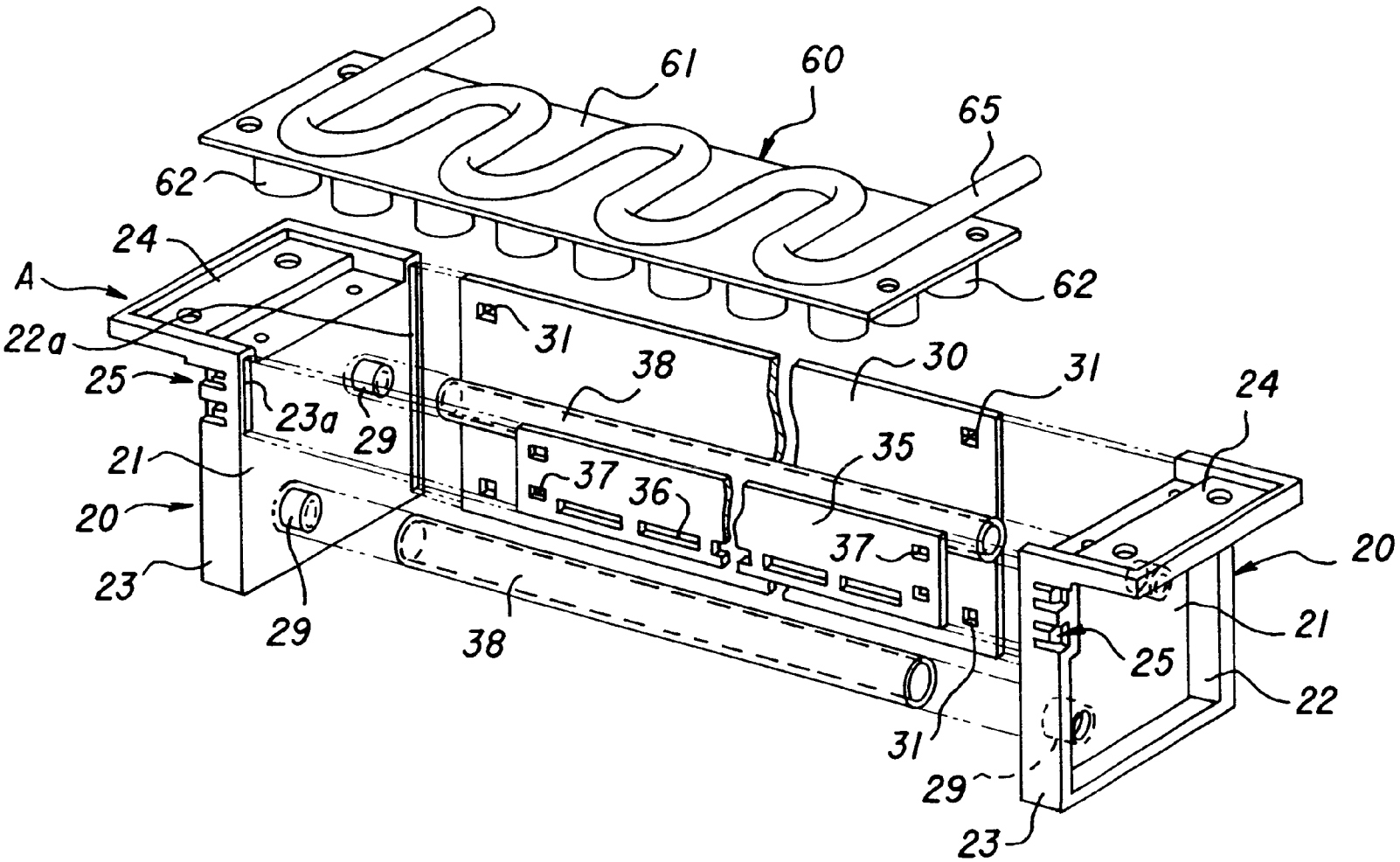
FIG. 10 is a perspective view illustrating a disassembled condition of the ice maker in a condition where the lateral width of the ice maker has been enlarged.

Illustrated in FIG. 10 is an ice maker of the open-cell type the size of which is twice of the ice maker in the embodiment described above, wherein the front and rear wall panels 35 and 30 are enlarged twice in lateral width and assembled with the side wall panels 21, and wherein the ice making chamber 60 and support rods 38 of the ice chute 70 are also enlarged in lateral width. The other construction and parts of the ice maker are substantially the same as those of the ice maker in the embodiment, except for the size of them.

What is claimed is:

1. An automatic ice maker of the open-cell type including a housing composed of a pair of spaced side wall panels and front and rear wall panels jointed at their opposite ends to the side wall panels, a water storage tank mounted to the bottom of the housing, a sprinkler mounted within the bottom portion of the housing and having a plurality of nozzles for spouting upward ice making water supplied from the water storage tank, a cooling pipe mounted within an ice making chamber formed in an upper portion of the housing, a plurality of ice making cell casings horizontally mounted in the ice making chamber and located above the nozzles of the sprinkler to be supplied with the ice making chamber spouted therefrom and to be cooled by refrigerant supplied into the cooling pipe, and an ice chute in the form of a lattice placed in a forwardly inclined condition between the sprinkler and the ice making cell casings to permit the ice making water spouted into the cell casings therethrough from the nozzles of the sprinkler and to receive ice cubes formed in and released from the cell casings, wherein the ice chute is detachably mounted on a forwardly inclined support portion provided on the side wall panels in the interior of the housing and retained in place by resilient engagement with the support portion.

2. An automatic ice maker of the open-cell type as claimed in claim 1, wherein the forwardly inclined support portion is in the form of a pair of spaced front and rear support rods mounted on the side wall panels at their opposite ends, and wherein the ice chute is provided at its bottom portion with a pair of spaced parallel support legs which are resiliently engaged with the front and rear support rods to retain the ice chute in place.

3. An automatic ice maker of the open-cell type as claimed in claim 1, wherein the water storage tank is supported at its opposite sides on a pair of spaced support portions integrally formed on the lower ends of the side wall panels when inserted into a bottom space of the housing from its front and is retained in place by engagement with the support portions of the side wall panels.

4. An automatic ice maker of the open-cell type as claimed in claim 3, wherein the support portions of the side wall panels are in the form of a pair of spaced inward flanges integrally formed with the lower ends of the side wall panels, and wherein an upper portion of the water storage tank is slidably supported at its opposite sides on the inward flanges of the side wall panels.

5. An automatic ice maker of the open-cell type as claimed in claim 3, wherein the support portions of the side wall panels are in the form of a pair of spaced support grooves formed in the lower end portions of the side wall panels, and wherein an upper portion of the water storage tank is slidably engaged with the support grooves at its opposite sides.

6. An automatic ice maker of the open-cell type as claimed in claim 1, wherein the sprinkler is supported and retained in place on a pair of spaced support portions integrally formed on the lower ends of the side wall panels and located above the water storage tank when inserted into the interior of the housing from its front.

7. An automatic ice maker of the open-cell type as claimed in claim 6, wherein the support portions of the side wall panels are in the form of a pair of spaced inward flanges integrally formed with the lower ends of the side wall panels and located above the water storage tank, and wherein the sprinkler is slidably supported at its opposite sides on the inward flanges of the side wall panels.

8. An automatic ice maker of the open-cell type as claimed in claim 6, wherein the support portions of the side wall panels are in the form of a pair of spaced support grooves formed along the lower end portions of the side wall panels and located above the water storage tank, and wherein the sprinkler is slidably engaged with the support grooves at its opposite sides.

9. An automatic ice maker of the open-cell type as claimed in claim 6, wherein the water storage tank is supported on a pair of spaced support portions integrally formed on the lower ends of the side wall panels when inserted into a bottom space of the housing from its front and is retained in place by engagement with the support portions of the side wall panels, and wherein the sprinkler is retained in place by engagement with a thrust member provided in the water storage tank.

* * * * *